US006107902A

United States Patent [19]

Zhang et al.

[11] Patent Number: 6,107,902

[45] Date of Patent: Aug. 22, 2000

[54] CIRCUIT BREAKER WITH VISIBLE TRIP INDICATOR

[75] Inventors: Zhiqun Brenda Zhang, West Hartford, Conn.; Anupam Gyaneshwardayal Tiwari, Bombay, India; Kevin J. Fuhr, Goshen, Conn.; Roger N. Castonguay, Terryville, Conn.; Javier I. Larranaga, Bristol, Conn.; Raymond K. Seymour, Plainville, Conn.

[73] Assignee: General Electric Company, Schenectady, N.Y.

[21] Appl. No.: 09/196,647

[22] Filed: Nov. 19, 1998

[51] Int. Cl.[7] ..... H01H 73/12

[52] U.S. Cl. ..... 335/17; 335/8; 335/9; 335/172; 200/308

[58] Field of Search ..... 335/17, 35, 167, 335/172, 174, 8, 9, 10; 200/308

[56] References Cited

U.S. PATENT DOCUMENTS 3,401,363 9/1968 Vyskocil et al. ..... 335/35
3,443,258 5/1969 Dunham et al. ..... 335/35
4,598,183 7/1986 Gardner et al. ..... 200/50 A
5,003,139 3/1991 Edds et al. ..... 200/401
5,089,796 2/1992 Glennon et al. ..... 335/172
5,694,101 12/1997 Lavelle et al. ..... 335/172
5,831,500 11/1998 Turner et al. ..... 335/17

*Primary Examiner*—Lincoln Donovan
*Assistant Examiner*—Raymond Barrera
*Attorney, Agent, or Firm*—Arthur G. Schaier; Carl B. Horton

[57] ABSTRACT

A circuit breaker including a housing having a window, a line terminal and a load terminal, and a circuit trip assembly. The circuit trip assembly includes a rotatable cradle, a moveable armature latch and a pivotable trip support including a trip indicator. Upon the occurrence of a tripping condition in the circuit breaker, the trip indicator moves from a first position where it is not visible through the window to a second position where it is visible through the window.

11 Claims, 7 Drawing Sheets

CIRCUIT BREAKER WITH VISIBLE TRIP INDICATOR

BACKGROUND OF THE INVENTION

The present invention relates generally to circuit breakers, and in particular, to an improved circuit breaker with a visible trip indicator arrangement for indicating when the circuit breaker is in a tripped condition.

Circuit breakers which incorporate a visible indication that the circuit breaker has been tripped are known in the art. Two such examples are described in U.S. Pat. Nos. 3,443,258 and 3,401,363. On the one hand, U.S. Pat. No. 3,443,258 describes the use of a rotating trip lever, in combination with a rocker coupled thereto by a spring, to achieve a visible trip indication. On the other hand, U.S. Pat. No. 3,401,363 describes a more complicated arrangement whereby both a trip bar and rocker are required to achieve the desirable visible trip indication.

The present invention still further improves the present state of the art by providing a visible trip flag indicator in an alternate circuit breaker construction that is coupled to, mounted on or is integral with a trip support.

It is therefore desirable to provide an improved circuit breaker and assembly which simplifies the aforementioned trip indication construction as well as further improves the state of the circuit breaker art.

The circuit breaker and circuit breaker assembly disclosed herein achieves the aforementioned and below mentioned objectives.

SUMMARY OF THE INVENTION

Generally speaking, in accordance with the invention, a circuit breaker that includes a visible trip indicator is provided. In the preferred embodiment, the circuit breaker includes a housing having a window, a line terminal and a load terminal, and a circuit trip assembly connected between the line terminal and the load terminal to trip the circuit breaker in response to a tripping condition. The circuit trip assembly preferably includes a rotatable cradle, a movable armature latch and a pivotable trip support that includes a trip indicator. Upon the occurrence of a tripping condition, the armature latch moves from a first to a second position which in turn causes the cradle to rotate from a first to a second position and contacts the trip support, causing the trip indicator to move from a first position where it is not visible through the window to a second position where the trip indicator is visible through the window.

Accordingly, it is an object of the present invention to provide a circuit breaker with an improved visible trip indicator construction.

Another object of the present invention is to provide a circuit breaker assembly in which a second circuit breaker can be tripped upon the sensing of a fault condition in a first circuit breaker, the tripping of either breaker causing a visible trip indication.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying figures, in which.

DETAILED DESCRIPTION OF THE PREFERRED EMBODIMENTS

Figure 1:
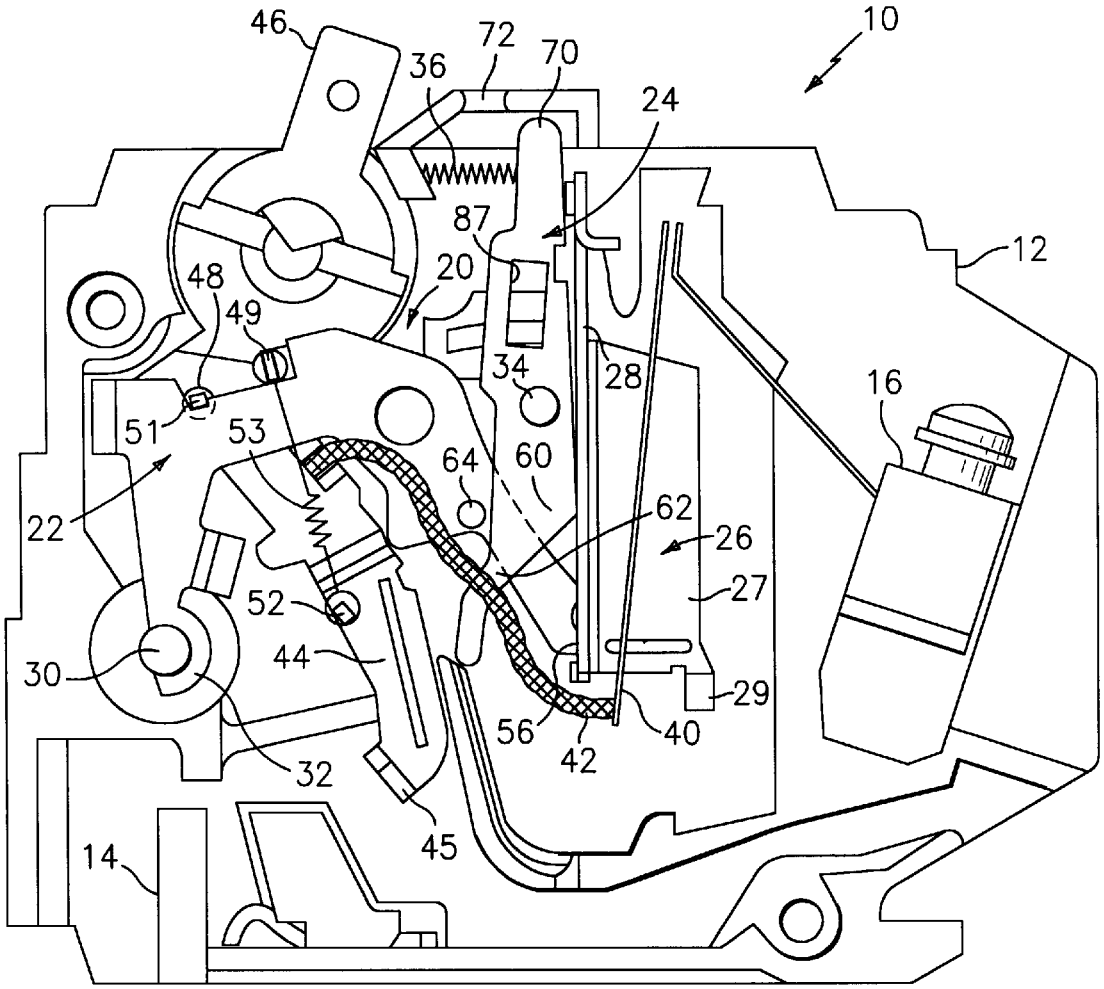
FIG. 1 is a front elevational view of a portion of a circuit breaker including a circuit trip assembly in the OFF condition in accordance with the present invention.

Reference is generally made to FIGS. 1–4 wherein a circuit breaker, generally indicated at 10, is constructed in accordance with the present invention. Circuit breaker 10 includes a housing 12, a line terminal 14, a load terminal 16, and a circuit trip assembly 20 connected between line terminal 14 and load terminal 16. It should be understood that like reference numerals will indicate like parts in all the figures, and that certain parts, obvious to one of ordinary skill and not material to the invention, have been omitted for simplicity.

Figure 2:
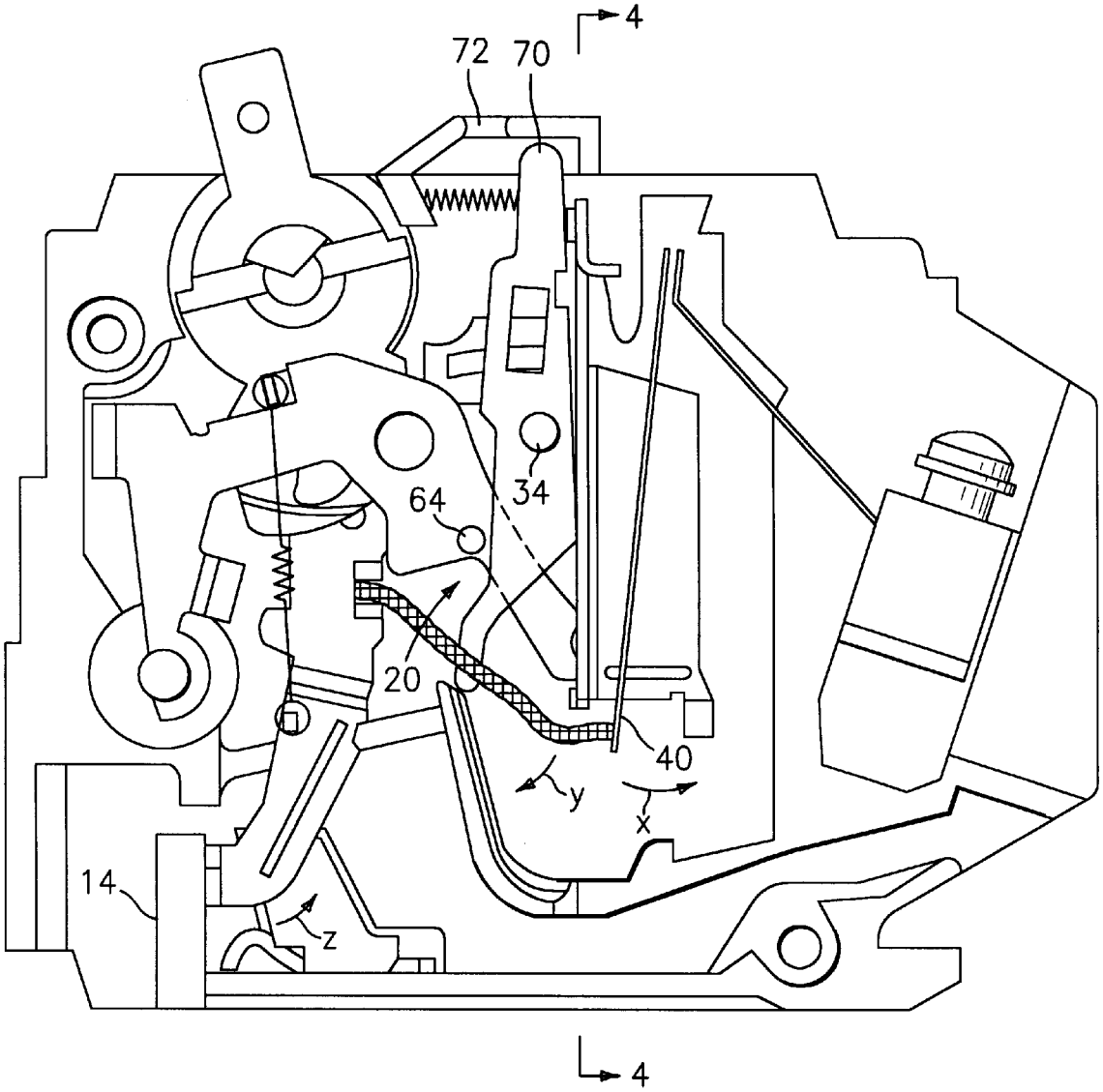
FIG. 2 is a front elevational view of a portion of the circuit breaker including the circuit trip assembly in the operating condition in accordance with the present invention.
Figure 3:
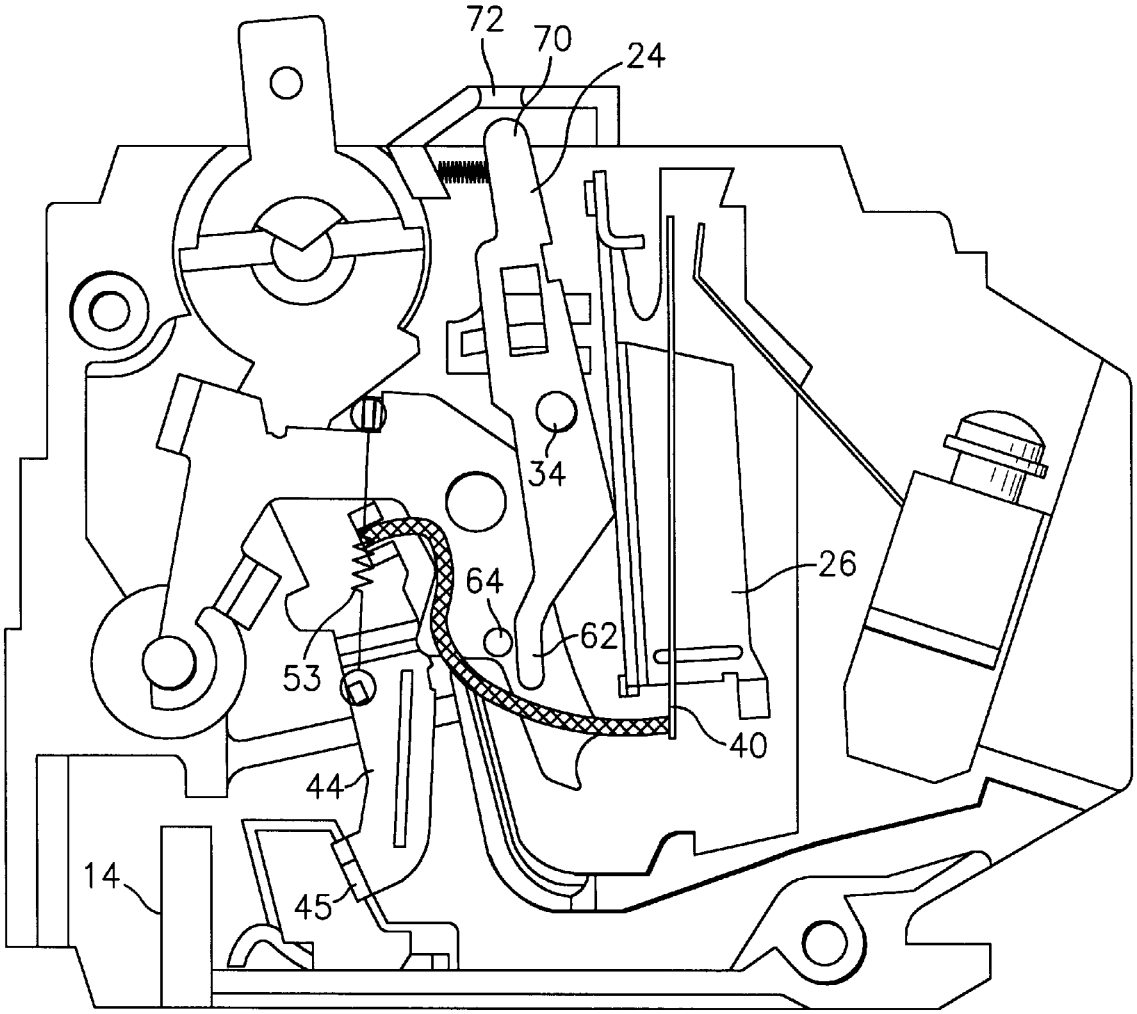
FIG. 3 is a front elevational view of a portion of the circuit breaker including the circuit trip assembly in the tripped condition in accordance with the present invention.

FIG. 1 illustrates circuit breaker 10 in the OFF condition while FIG. 2 illustrates circuit breaker 10 in the operating condition and FIG. 3 illustrates circuit breaker 10 in the tripped condition. Circuit trip assembly 20 includes a cradle generally indicated at 22, which is rotatable between the ON position, at least a first position when circuit breaker 10 is in an operating condition (FIG. 2) and a second position when circuit breaker 10 is in a tripped condition (see FIG. 3). Housing 12 includes a mounting pin 30 preferably formed integrally therewith. Cradle 22 includes an integrally formed "C" portion 32 which engages mounting pin 30 so as to achieve the rotatable nature of cradle 22.

Circuit trip assembly 20 also includes a trip assembly, generally indicated at 26, which is engagable with cradle 22 (as discussed below) and moveable between at least a first position when circuit breaker 10 is in the operating condition (FIG. 2) and a second position when circuit breaker 10 is in the tripped condition (FIG. 3). Trip assembly 26 may also be in another position when breaker 10 is in the OFF condition (FIG. 1). Trip assembly 26 includes a magnet 27, an armature latch 28, and a catch 29, all preferably integrally formed with one another, the functions of which will be discussed below.

Circuit trip assembly 20 also includes a trip support, generally indicated at 24, positioned intermediate cradle 22 and trip assembly 26 and engagable with cradle 22 and trip assembly 26 (as discussed below). Trip support 24 is pivotable about an integrally formed mounting pin 34 which engages a recess (not shown) in housing 12. Trip support 24 pivots between at least a first position when circuit breaker 10 is in the operating condition and a second position when circuit breaker 10 is in the tripped condition. Trip support 24 may also be in an alternate position when circuit breaker 10 is in the OFF condition. Trip support 24 preferably includes an aperture 87 (the function of which is discussed below with reference to FIG. 6). Further, trip support 24 includes a leg portion 60, itself having a foot portion 62 integrally formed therewith. Trip support 24 also includes a trip indicator 70 which may be integrally formed therewith. Trip indicator 70 may be of various colors such as red or orange, and will indicate when circuit breaker 10 is in the tripped condition as more fully discussed below.

A spring 36 is disposed intermediate one end of armature latch 28 and an interior wall of housing 12 so as to permit the biasing and movement of trip assembly 26.

Circuit breaker 10 also includes a bi-metal 40 disposed within housing 12. Bi-metal 40 is also movable within housing 12 in a manner that would be well understood by one of ordinary skill in the art and need not be repeated herein. A braided copper wire 42 is provided and electrically connects between line terminal 14 and load terminal 16 by way of bi-metal 40 and a contact arm 44 (and a contact pad 45 integral therewith), the details of which would also be understood by one of ordinary skill in the art.

Housing 12 also includes a window 72 to permit trip indicator 70 to be viewed therethrough when circuit breaker 10 is in the tripped condition. Window 72 may be made of durable plastic, glass or the like.

A handle 46 is provided and is movable between an OFF position (FIG. 1), at least a first position (FIG. 2) and a second position (as shown in FIG. 3) respectively coinciding with the OFF, operating or tripping condition of the circuit breaker. Contact arm 44 includes an integrally formed first tab 51 and an integrally formed second tab 52. Tab 51 cooperates with an aperture 48 in handle 46 to move and rotate arm 44 from its OFF position to its operating position in a manner which would be well understood by one skilled in the art. Likewise, cradle 22 preferably includes an integrally formed tab 49. Between tabs 49 and 52 is disposed a spring 53 which biases cradle 22 relative to contact arm 44. When handle 46 rotates from its OFF position to its operating position, contact arm 44 likewise moves from its OFF position (FIG. 1) to its operating position (FIG. 2), such that contact pad 45 is in electrical contact with line terminal 14, which in turn causes cradle 22 to move into its operating position.

Figure 4:
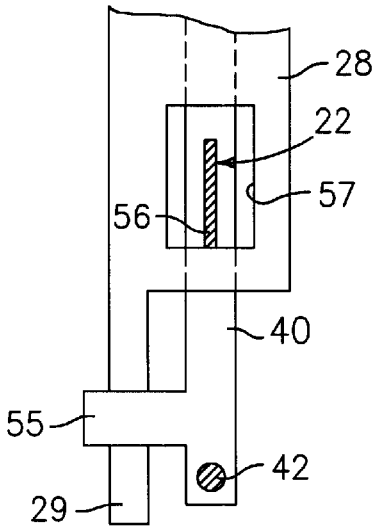
FIG. 4 is a cross-sectional view of FIG. 2 taken about lines 4—4.

When circuit breaker 10 is in its operating condition (FIG. 2), cradle 22 is biased away from trip support 24 by way of its engagement with armature latch 28. In particular, cradle 22 includes an integrally formed toe 56 which engages an aperture 57 within armature latch 28 (FIG. 4). Cradle 22 also includes a pin 64, integrally formed therewith, that engages foot portion 62 of trip support 24 when cradle 22 rotates from its operating position to its tripped position.

Trip assembly 20 may be tripped either by a thermal overload which is detected by bi-metal 40 or by a current surge between line terminal 14 and load terminal 16. When detecting the thermal overload, it will be well understood that bimetal 40 will actually bend upon a threshold thermal condition, its detection being due to the heating thereof. Upon this bending, bi-metal 40 having an integrally formed tab 55 (see FIG. 4) will engage catch 29 of trip assembly 26. In this way, armature latch 28 will move in a direction indicated by the arrow "x" illustrated in FIG. 2. The resulting operation by way of the movement of armature latch 28 from its first position to its second position in direction "x" will be explained below. Similarly, in the event circuit breaker 10 detects an undesirable current surge, the large electromagnetic field created around bi-metal 40 draws armature latch 28 theretowards causing armature latch 28 similarly to move in the "x" direction. This operation should be understood by one skilled in the art.

Accordingly, when armature latch 28 moves in the "x" direction, toe 56 of cradle 22 disengages from aperture 57 of armature latch 28 and rotates in a direction indicated by arrow "y" (i.e. from its first position to its second position by way of the biasing of spring 53). Arm 44 likewise rotates in the direction of arrow "z" also in part by way of the biasing of spring 53. Upon the rotation of cradle 22, pin 64 thereof will engage (FIG. 3) foot portion 62 of trip support 24 so as to cause trip support 24 to rotate about pin 34 as will now be readily apparent when the tripped condition occurs either by detection of the current overload or thermal overload.

Figure 5:
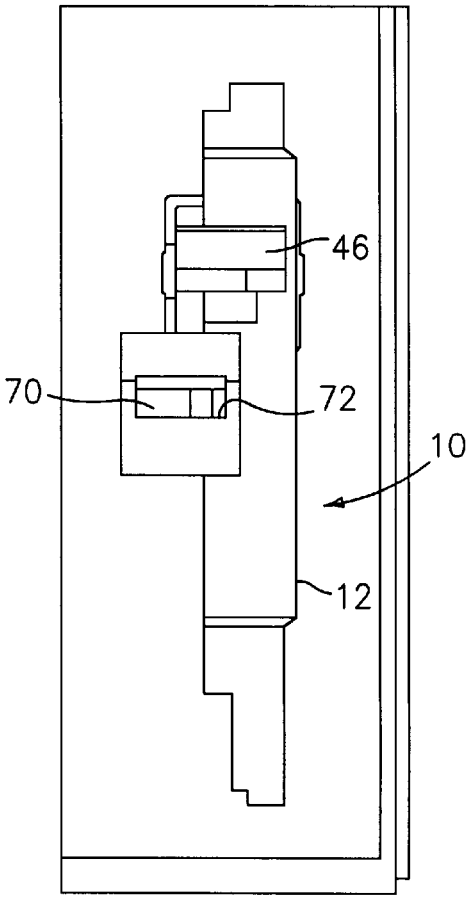
FIG. 5 is a top plan view of the circuit breaker constructed in accordance with the present invention illustrating a tripped condition.

By rotation of trip support 24, trip indicator 70 will likewise rotate in the same direction (in the depiction, counterclockwise) about pin 34 from a first position where it is not visible through window 72 (FIG. 1 or 2) to a second position where trip indicator 70 is visible through window 72 (see FIG. 3). Accordingly, it can now be appreciated that when circuit breaker 10 is either in its OFF or operating condition, trip indicator 70 is not visible through window 72 and when a tripped condition occurs, the interengagement of the various components of assembly 20 causes trip indicator 70 to become visible through window 72. FIG. 5 illustrates trip indicator 70 being visible through window 72.

Figure 6:
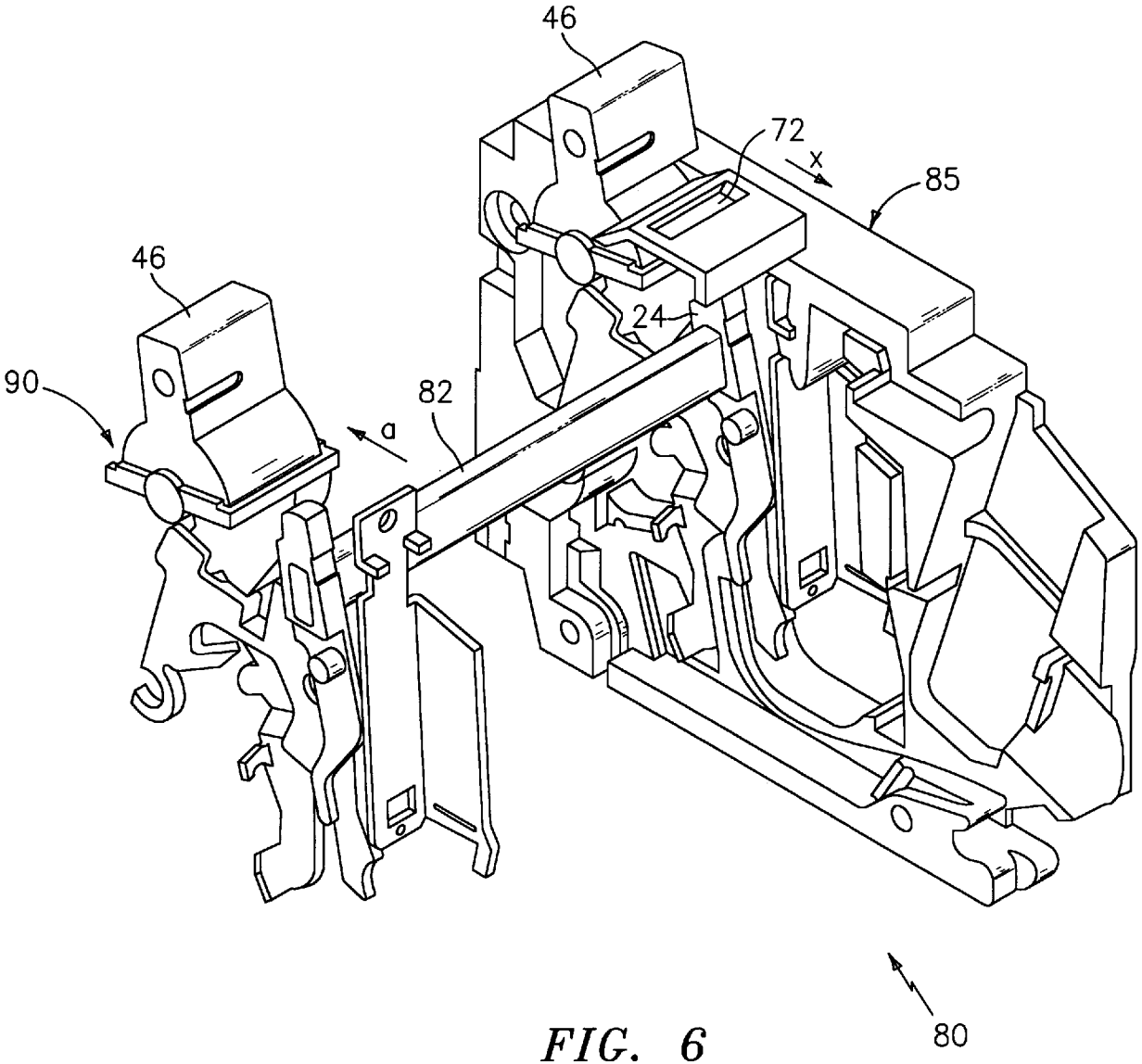
FIG. 6 is a cutaway prospective view of a circuit breaker assembly constructed in accordance with the present invention.

Reference is now made to FIG. 6 which illustrates a circuit breaker assembly 80 which preferably comprises at least a first circuit breaker 85 and a second breaker 90, each circuit breaker including all of the aforementioned features and structure indicated in circuit breaker 10, in (FIG. 1) with the exception that assembly 80 has only one trip indicator as illustrated in breaker 85. Accordingly, reference numerals indicating like structure will also be used herein. Coupling circuit breakers 85 and 90 is at least a trip bar 82 preferably made from molded plastic. Trip bar 82 engages each respective trip support 24 by way of its insertion into the respective apertures 87, in (FIG. 1).

In operation, when the trip support in either circuit breaker 85 or 90 is rotated upon a tripping condition as discussed above, trip bar 82 will also rotate in a direction indicated by arrow "a" (FIG. 6) together with the trip supports in each of the circuit breakers 85 and 90. For example, in the event breaker 90 senses a tripping condition as explained above, the rotation of trip support 24 in breaker 90 causes the rotation of trip bar 82 causing trip support 24 in breaker 85 to rotate thereby causing armature latch 28 in the aforementioned non-tripping circuit breaker 85 to move (in the direction indicated by arrow "x") thus causing cradle 22 to disengage therewith (as discussed above) causing cradle 22 to rotate (in the aforementioned direction "y") causing pin 64 to engage foot portion 62 of trip support 24 in breaker 85. Accordingly, in a manner as set forth above, trip indicator 70 in breaker 85 will be visible through window 72.

Figure 7:
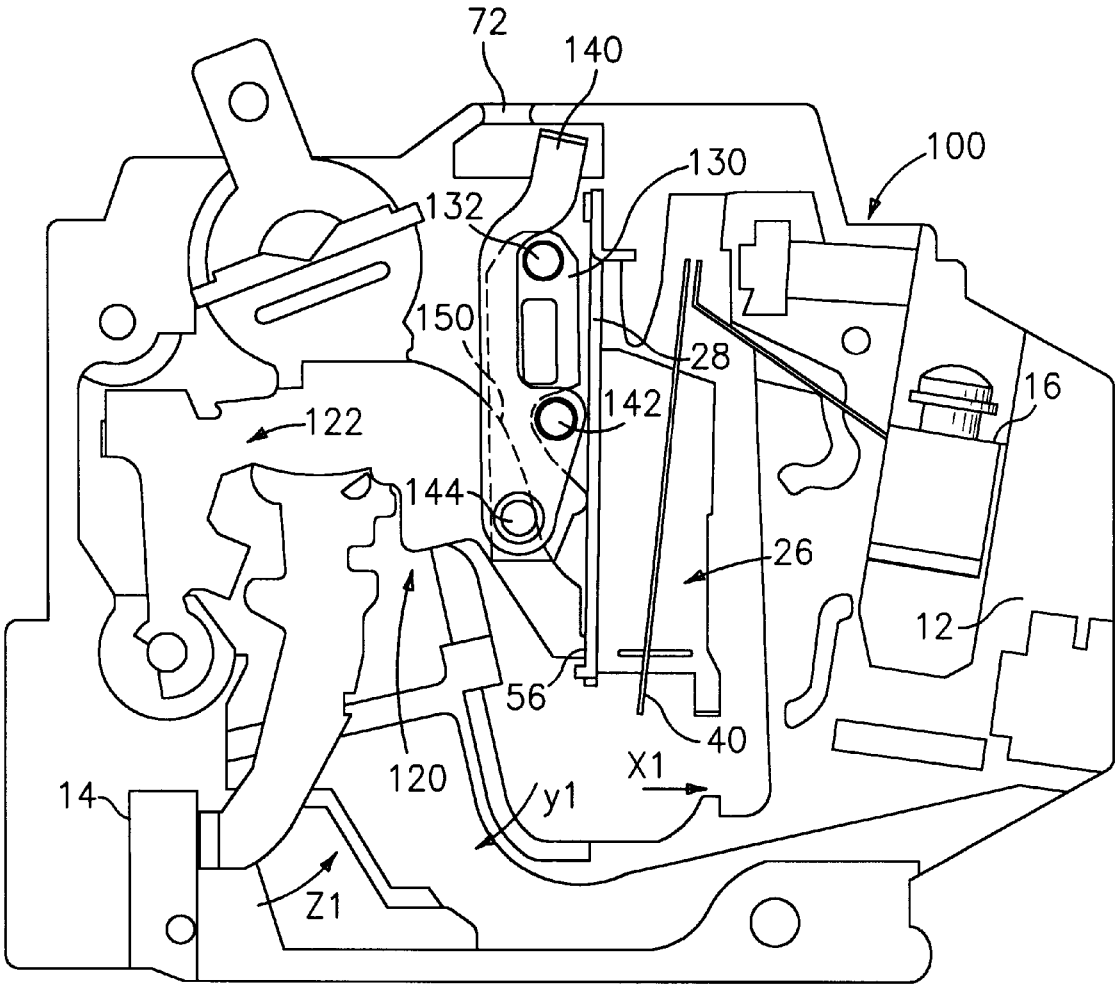
FIG. 7 is a front elevational view of a portion of a circuit breaker including a circuit trip assembly in the operating condition in accordance with a second embodiment of the present invention.
Figure 8:
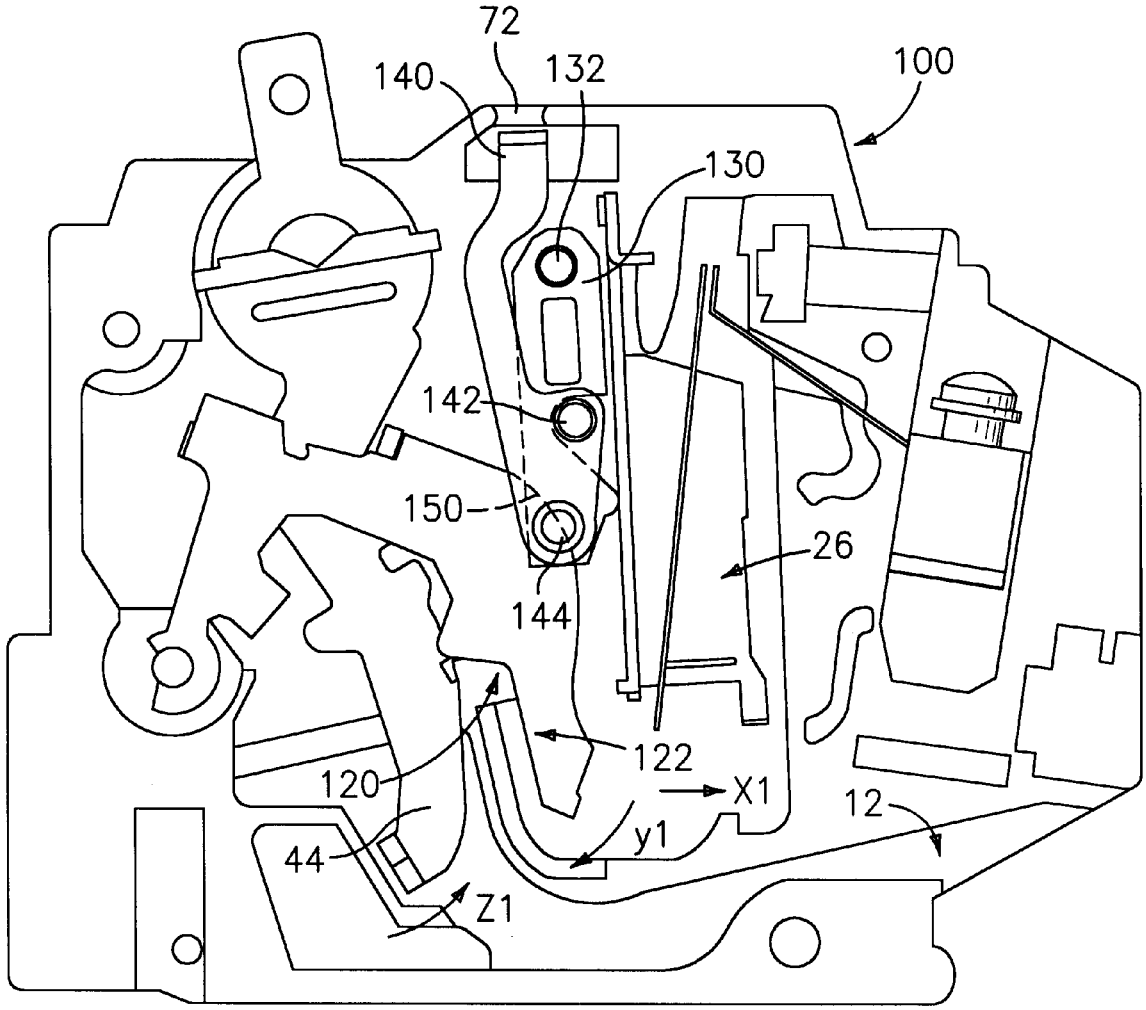
FIG. 8 is a front elevational view of a portion of the circuit breaker of FIG. 7 in the tripped condition.

Reference is now made to FIGS. 7–8 wherein a circuit breaker, generally indicated at 100, constructed in accordance with a second embodiment of the present invention is depicted. Like reference numerals to circuit breaker 10 denote like parts. Also, parts such as the bi-metal, springs and electrical wires, such as wire 42 have been omitted for simplicity. Circuit breaker 100 likewise includes a housing 12, a line terminal 14, a load terminal 16, and a circuit trip assembly 120 connected between line terminal 14 and load terminal 16. Also, like reference numerals in FIGS. 7 and 8 will indicate like parts.

FIG. 7 illustrates circuit breaker 100 in the operating condition and FIG. 8 illustrates circuit breaker 100 in the tripped condition. Circuit trip assembly 120 includes a cradle 122 which is rotatable between at least a first position when circuit breaker 100 is in the operating condition and a second position when circuit breaker 100 is in a tripped condition.

In this second embodiment, the trip support is no longer of a unitary construction but rather comprises two components, a trip cam 130 and a trip indicator 140. Keeping in mind the general operation above with respect to circuit breaker 10, in this second embodiment, trip cam 130 is positioned intermediate cradle 122 and trip assembly 26 and engagable therewith. Trip cam 130 is pivotable between at least a first position when circuit breaker 100 is in the operating condition and a second position when circuit breaker 100 is in the tripped condition. In particular, trip cam 130, when pivoting from the first to the second positions, will rotate counter-clockwise about a pin 132 (integral with trip cam 130) insertable in a recess (not shown) in housing 12.

When circuit breaker 100 is in its operating condition, cradle 122 is biased away from trip cam 130 by way of its engagement with trip assembly 26 as disclosed above with respect to the first embodiment.

In a tripping condition similar to that disclosed above, when armature latch 28 moves in the "x1" direction, toe 56 of cradle 122 disengages from aperture 57 of armature latch 28 and rotates in a direction indicated by arrow "y1." Arm 44 likewise rotates in the direction of arrow "z1." Upon the rotation of cradle 122, a knee portion 150 thereof will engage (FIG. 8) trip support 130 so as to cause trip cam 130 to rotate about pin 132. It should be understood that trip cam 130 is "stepped" if viewed in cross-section, so as to permit the invention to operate as described. That is, as viewed in FIGS. 7 and 8, knee portion 150 of cradle 122 is behind indicator 140 and a portion of cam 130. That is, cradle 122 is located, at knee portion 150 when in the tripped condition, in between cam 130 and the housing. Such is indicated by the dotted lines.

The rotation of trip cam 130 further causes armature latch 28 to pivot in a manner similar to breaker 10 in FIG. 3. Trip indicator 140 will likewise rotate about pin 142 of housing 12 from a first position where it is not visible through window 72 in housing 12 to a second position where trip indicator 140 is visible through window 72. A guide pin 144 of trip cam 130 is provided to transfer the movement of the trip cam 130 to trip indicator 140 to rotate about pin 142.

In all other respects, the construction and operation of this second embodiment is similar to the construction and operation of the first embodiment. For example, the portion of trip indicator 140 that is visible through window 72 may be of various colors such as red or orange, and will indicate when circuit breaker 100 is in the tripped condition.

It will be thus appreciated that the circuit breaker disclosed herein is a novel construction that utilizes a trip support that provides a visible trip indication, wherein the trip support may be of a unitary construction or comprise a trip cam and separate trip indicator. Additionally, the circuit breaker assembly construction disclosed herein facilitates the ability to provide for a visible trip indication upon a tripping condition in an assembly comprising multiple circuit breakers.

It is also to be understood that the following claims are intended to cover all of the generic and specific features of the invention described herein and all statements of the scope of the invention which as a matter of language might fall therebetween. For example, the terms rotatable, moveable and pivotable are not limiting and may be used interchangeably.

What we claim is:

1. A circuit breaker, the circuit breaker being in one of at least an operating condition or a tripped condition, and wherein the circuit breaker comprises a housing having a window, a line terminal and a load terminal, and a circuit trip assembly connected between the line terminal and the load terminal to trip the circuit breaker in response to a tripping condition, wherein the circuit trip assembly is within the circuit breaker housing and comprises:

a cradle rotatable between at least a first position when the circuit breaker is in the operating condition and a second position when the circuit breaker is in the tripped condition, the rotation from the first position to the second position being in a clockwise direction;

an armature latch engageable with the cradle and moveable between at least a first position when the circuit breaker is in the operating condition and a second position when the circuit breaker is in the tripped condition;

a trip support, mounted about a pin and positioned intermediate the cradle and the armature latch and for engagement with the cradle and the armature latch, the trip support comprising a trip indicator and a leg portion, both the trip indicator and the leg portion being pivotable in a counterclockwise direction about the pin between at least respective first positions such that the cradle is out of engagement with the trip support when the circuit breaker is in the operating condition and respective second positions when the circuit breaker is in the tripped condition;

wherein the occurrence of the tripping condition in the circuit breaker causes the moving of the armature latch from its first position to its second position which in turn causes the cradle to rotate in the clockwise direction from its first position where the cradle is out of engagement with the trip support to its second position thereby engaging the trip support by contacting the leg portion of the trip support and causing the leg portion of the trip support to pivot about the pin and rotate in the counterclockwise direction causing the trip indicator to pivot about the pin and rotate in the counterclockwise direction, from a first position where it is not visible through the window to a second position where the trip indicator is visible through the window.

2. The circuit breaker as claimed in claim 1, including a contact arm engagable with the line terminal when the circuit breaker is in the operating condition and not engagable with the line terminal when the circuit breaker is in the tripped condition.

3. The circuit breaker as claimed in claim 1, wherein the leg portion of the trip support and the trip indicator both pivot in the counterclockwise direction about the pin upon the occurrence of a tripped condition.

4. The circuit breaker as claimed in claim 1, wherein the cradle directly contacts the trip support when the cradle rotates from its first position to its second position.

5. The circuit breaker as claimed in claim 4, wherein the trip indicator and the leg portion are integrally formed with the trip support.

6. The circuit breaker as claimed in claim 4, wherein the cradle includes at least a cradle pin integrally formed therewith and the leg portion of the trip support includes a foot portion;

wherein upon a tripped condition, the cradle pin engages the foot portion of the trip support causing the leg portion of the trip support to remain in its second position until the circuit breaker is reset, thereby causing the trip indicator to remain visible in the window until the circuit breaker is reset.

7. A circuit breaker assembly comprising a first circuit breaker and at least a second circuit breaker, each of the first and second circuit breakers being in one of at least an operating condition or a tripped condition, and wherein each of the first and second circuit breakers comprise a circuit breaker housing, a line terminal and a load terminal, and a circuit trip assembly connected between the line terminal and the load terminal to respectively trip either the first or second circuit breaker in response to a tripping condition in the respective circuit breaker, wherein each circuit trip assembly is within its respective circuit breaker housing and comprises:

a cradle rotatable between at least a first position when the respective circuit breaker is in the operating condition and a second position when the respective circuit breaker is in the tripped condition;

an armature latch engagable with the cradle and moveable between at least a first position when the respective circuit breaker is in the operating condition and a second position when the respective circuit breaker is in the tripped condition;

a trip support engagable with the cradle and the armature latch, the trip support comprising at least a leg portion, the leg portion being pivotable about a pin between at least a first position when the circuit breaker is in the operating condition and a second position when the circuit breaker is in the tripped condition;

wherein the assembly comprises a trip bar coupled between the trip support in the first circuit breaker and the trip support in the second circuit breaker; and further wherein the trip support of the first circuit breaker comprises a trip indicator pivotable about its respective pin between a first position when the first circuit breaker is in the operating condition and a second positions when the circuit breaker is in the tripped condition;

wherein the occurrence of the tripping condition in the second circuit breaker causes the moving of the armature latch of the second circuit breaker from its first position to its second position which in turn causes the cradle of the second circuit breaker to rotate from its first position to its second position thereby contacting the leg portion of the trip support of the second circuit breaker causing the trip indicator in the first circuit breaker to pivot about its respective pin from a first position where it is not visible through a window in the first circuit breaker to a second position where the trip indicator is visible through the window in the first circuit breaker.

8. The circuit breaker as claimed in claim 7, wherein the leg portion of the trip support in the second circuit breaker and the trip indicator in the first circuit breaker both pivot in the counterclockwise direction about each circuit breaker's respective pins upon the occurrence of a tripped condition.

9. A circuit breaker, the circuit breaker being in one of at least an operating condition or a tripped condition, and wherein the circuit breaker comprises a housing having a window, a line terminal and a load terminal, and a circuit trip assembly connected between the line terminal and the load terminal to trip the circuit breaker in response to a tripping condition, wherein the circuit trip assembly is within the circuit breaker housing and comprises:

a cradle rotatable between at least a first position when the circuit breaker is in the operating condition and a second position when the circuit breaker is in the tripped condition;

an armature latch engageable with the cradle and moveable between at least a first position when the circuit breaker is in the operating condition and a second position when the circuit breaker is in the tripped condition;

a trip support comprising a trip cam pivotable about a trip cam pin, the trip cam having a trip indicator guide pin, and a trip indicator pivotable about a housing pin and guided by the trip indicator guide pin, the trip cam being engageable with the cradle and the armature latch, both the trip cam and the trip indicator being pivotable between at least respective first positions when the circuit breaker is in the operating condition and respective second positions when the circuit breaker is in the tripped condition;

wherein the occurrence of the tripping condition in the circuit breaker causes the moving of the armature latch from its first position to its second position which in turn causes the cradle to rotate from its first position to its second position thereby contacting the trip cam causing the trip indicator to rotate about the housing pin and be guidably moved by the movement of the trip indicator guide pin, from a first position where it is not visible through the window to a second position where the trip indicator is visible through the window.

10. The circuit breaker as claimed in claim 9, wherein the cradle directly contacts the trip cam when the cradle rotates from its first position to its second position.

11. The circuit breaker as claimed in claim 9, wherein the trip indicator includes an aperture for receiving the trip indicator guide pin.

* * * * *